US008506725B2

(12) United States Patent
Bragg

(10) Patent No.: US 8,506,725 B2
(45) Date of Patent: Aug. 13, 2013

(54) WASHING APPLIANCE AND ASSOCIATED METHOD

(75) Inventor: John C. Bragg, Evansville, IN (US)

(73) Assignee: Electrolux Home Products, Inc., Cleveland, OH (US)

( * ) Notice: Subject to any disclaimer, the term of this patent is extended or adjusted under 35 U.S.C. 154(b) by 690 days.

(21) Appl. No.: 12/032,097

(22) Filed: Feb. 15, 2008

(65) Prior Publication Data

US 2009/0205680 A1 Aug. 20, 2009

(51) Int. Cl.
*B08B 3/00* (2006.01)

(52) U.S. Cl.
USPC ..... 134/56 D

(58) Field of Classification Search
None
See application file for complete search history.

(56) References Cited

U.S. PATENT DOCUMENTS

| | | | | |
|---|---|---|---|---|
| 3,807,418 | A | 4/1974 | Jenkins | |
| 3,888,269 | A | 6/1975 | Bashark | |
| 5,603,233 | A | 2/1997 | Erickson et al. | |
| 5,729,025 | A | 3/1998 | Erickson et al. | |
| 5,797,409 | A | 8/1998 | Cooper et al. | |
| 5,800,628 | A * | 9/1998 | Erickson et al. | 134/18 |
| 5,803,985 | A * | 9/1998 | Alvord | 134/18 |
| 5,806,541 | A | 9/1998 | Cooper et al. | |
| 5,957,144 | A | 9/1999 | Neff et al. | |
| 6,007,640 | A | 12/1999 | Neff et al. | |
| 6,182,674 | B1 | 2/2001 | Jozwiak et al. | |
| 6,432,216 | B1 | 8/2002 | Thies | |
| 6,887,318 | B2 | 5/2005 | Bashark | |
| 7,086,406 | B2 | 8/2006 | Jung et al. | |
| 7,241,347 | B2 | 7/2007 | Elick et al. | |
| 7,246,396 | B2 | 7/2007 | Czyzewski et al. | |
| 7,371,288 | B2 | 5/2008 | Cho et al. | |
| 2003/0061004 | A1 * | 3/2003 | Discenzo | 702/182 |
| 2003/0196278 | A1 | 10/2003 | Durfee | |
| 2004/0111807 | A1 | 6/2004 | Jung et al. | |
| 2004/0118435 | A1 | 6/2004 | Jung et al. | |
| 2004/0173245 | A1 * | 9/2004 | Elick et al. | 134/25.2 |
| 2004/0200512 | A1 * | 10/2004 | Clouser et al. | 134/57 D |
| 2006/0237052 | A1 | 10/2006 | Picardat et al. | |
| 2007/0102030 | A1 | 5/2007 | Young | |
| 2007/0181154 | A1 | 8/2007 | Beer et al. | |
| 2007/0272602 | A1 | 11/2007 | Czyzewski et al. | |
| 2008/0023042 | A1 | 1/2008 | Jayakaran | |
| 2008/0128000 | A1 | 6/2008 | Kennichi et al. | |
| 2008/0128001 | A1 | 6/2008 | Kennichi et al. | |

OTHER PUBLICATIONS

Decision on Appeal from U.S. Appl. No. 11/615,564, mailed Oct. 13, 2010.

* cited by examiner

*Primary Examiner* — Michael Barr
*Assistant Examiner* — Jason Ko
(74) *Attorney, Agent, or Firm* — Alston & Bird LLP

(57) ABSTRACT

A washing appliance is provided, having a circulation pump for circulating a washing fluid. A monitoring device is capable of monitoring a condition of the circulated washing fluid. A control device is in communication with the monitoring device and is configured to direct execution of one of a plurality of automatic wash programs by the washing appliance, wherein each automatic wash program includes a plurality of serially-conducted wash segments, each including at least one pre-wash segment and at least one post-wash segment. The control device is further configured to direct the monitoring device to dynamically monitor the washing fluid condition during at least one of the at least one pre-wash segment and the at least one post-wash segment, and to direct an alteration of the washing fluid in response to the monitoring device determining that the washing fluid condition exceeds a threshold. An associated method is also provided.

22 Claims, 3 Drawing Sheets

WASHING APPLIANCE AND ASSOCIATED METHOD

BACKGROUND OF THE INVENTION

1. Field of the Invention

Figure 1:
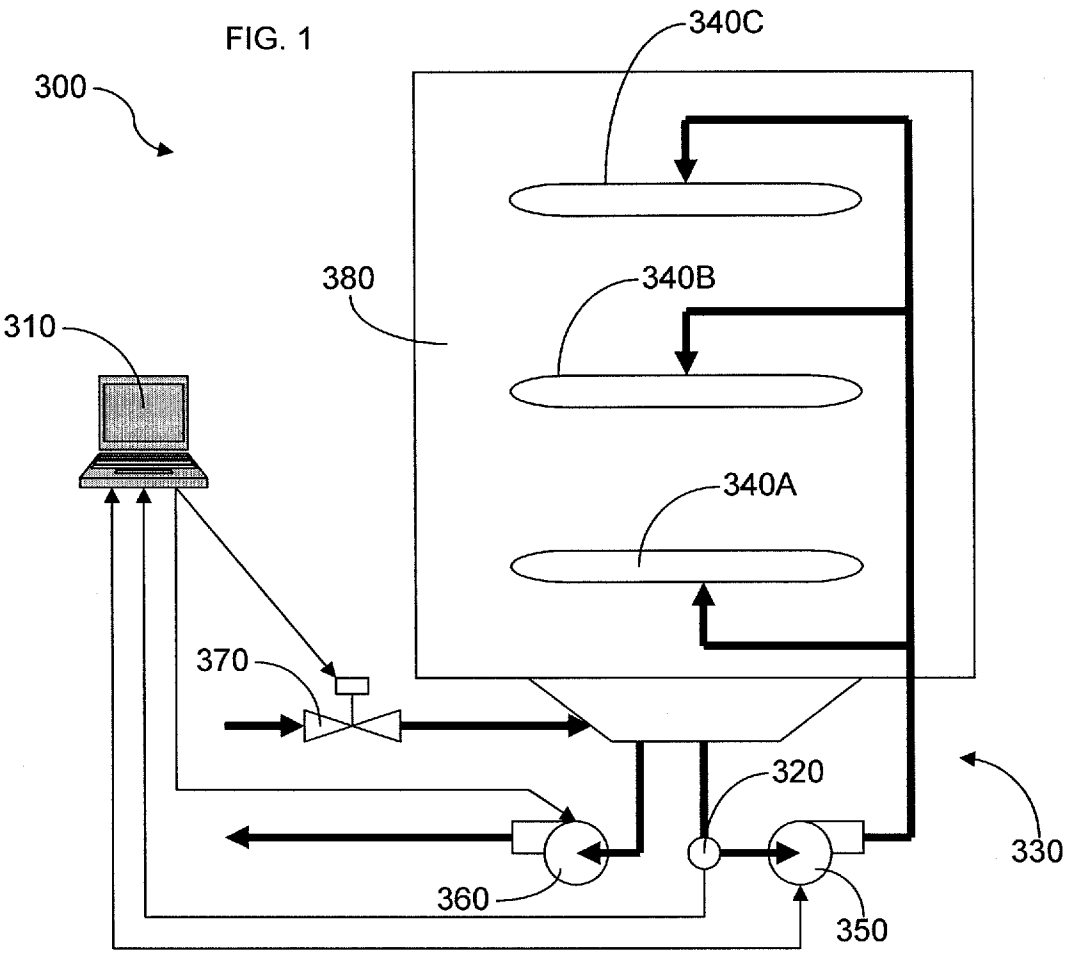

The present disclosure relates to washing appliances and, more particularly, to a washing appliance and associated control method.

2. Description of Related Art

A dishwasher appliance typically includes a number of selectable automatic wash programs, wherein any one such wash program may be selected by the user depending on the nature of the load (i.e., a "normal" wash cycle for varying food soil levels on the dishware, a "china/crystal" wash cycle, an "economy" cycle, a "speed wash" cycle, or a "rinse and hold" cycle). In such instances, the selected wash program may adjust or include a distinct menu of a number of different parameters that affect the particular wash cycle. That is, the selected cycle may have certain "pre-wash" characteristics, rinse (post-wash) characteristics, and "main wash" characteristics, including, for example, particular durations for each cycle segment, the order and number of cycle segments, the amount of water used, and the temperature of the water.

The intent of the various wash programs is to remove food soils and debris from the dishware therein. In doing so, however, various other factors such as, for example, water consumption, energy consumption, and the duration of the wash cycle must be considered in determining the effectiveness of a particular wash program. These "other" factors of power consumption, water consumption, etc., may be adversely affected by draining and re-filling the dishwasher appliance (i.e., increased water usage, as well as energy usage due to the operation of the pump used for draining the water). As such, one area of interest is effective filtration of the water used in the various cycle segments, since the water used for washing the dishware is often re-circulated over the dishware. Effective filtration leads to a more effective wash program since fewer food soils are re-circulated back over the dishware. In addition, less draining and re-filling conserves water and energy, and may help to reduce the overall duration of the wash cycle. As such, it would be desirable to optimize wash programs in a dishwasher so as to provide sufficient flexibility to match individual programs to the nature of the dishware being washed, as well as the magnitude and condition of the food soils thereon, while providing an effective wash cycle which conserves or optimizes resources.

In some instances, the wash cycle may involve monitoring the turbidity of the wash water, for example, between particular cycle segments. As such, the dishwasher generally completes a cycle segment before comparing the turbidity of the wash water to a predetermined threshold and selecting an appropriate cycle response (i.e., if the wash water is too "dirty" (high turbidity), then may drain and re-fill the wash water, and/or clean the filtration system). However, such progress to the end a particular cycle segment before determining the turbidity thereof, may undesirably cause the above-threshold wash water to be re-circulated back onto the dishware, while also taxing the filtration system. In addition, further energy, water, and time may be required to effectively clean the dishware. Also, continuing the cycle segment to the end thereof, even though the turbidity of the wash water may be above the threshold, may result in a higher energy consumption for the dishwasher to complete that cycle segment.

Thus, there exists a need for an apparatus and/or method for monitoring and/or sensing various conditions of a dishwasher or other washing appliance, and adjusting and optimizing the parameters of a selected wash program in response thereto.

BRIEF SUMMARY OF THE INVENTION

The above and other needs are met by the present disclosure which, in one embodiment, provides a washing appliance having a circulation pump for circulating a washing fluid in a tub portion. Such a washing appliance comprises a monitoring device configured to be capable of monitoring a condition of the washing fluid circulated within the tub portion. A control device is in communication with the monitoring device and is configured to direct execution of one of a plurality of automatic wash programs by the washing appliance, wherein each automatic wash program includes a plurality of serially-conducted wash segments, and the wash segments include at least one pre-wash segment and/or at least one post-wash segment. The control device is further configured to direct the monitoring device to dynamically monitor the condition of the washing fluid during at least one of the at least one pre-wash segment and the at least one post-wash segment of the executed wash program, and to direct an alteration of the washing fluid in response to the monitoring device determining that the condition of the washing fluid exceeds a threshold.

Another advantageous aspect of the present invention comprises a method of controlling a washing appliance having circulation pump for circulating a washing fluid therein. Such a method comprises executing one of a plurality of automatic wash programs in the washing appliance, wherein each automatic wash program includes a plurality of serially-conducted wash segments, and the wash segments include at least one pre-wash segment and at least one post-wash segment. A condition of the circulated washing fluid is dynamically monitored during at least one of the at least one pre-wash segment and the at least one post-wash segment of the executed wash program. The washing fluid is then altered in response to the condition of the washing fluid exceeding a threshold.

Thus, the washing appliance and associated method, as disclosed in conjunction with various embodiments of the present disclosure, provide many advantages that may include, but are not limited to, improving efficiency and wash quality of the washing appliance.

BRIEF DESCRIPTION OF THE SEVERAL VIEWS OF THE DRAWING(S)

Figure 2:
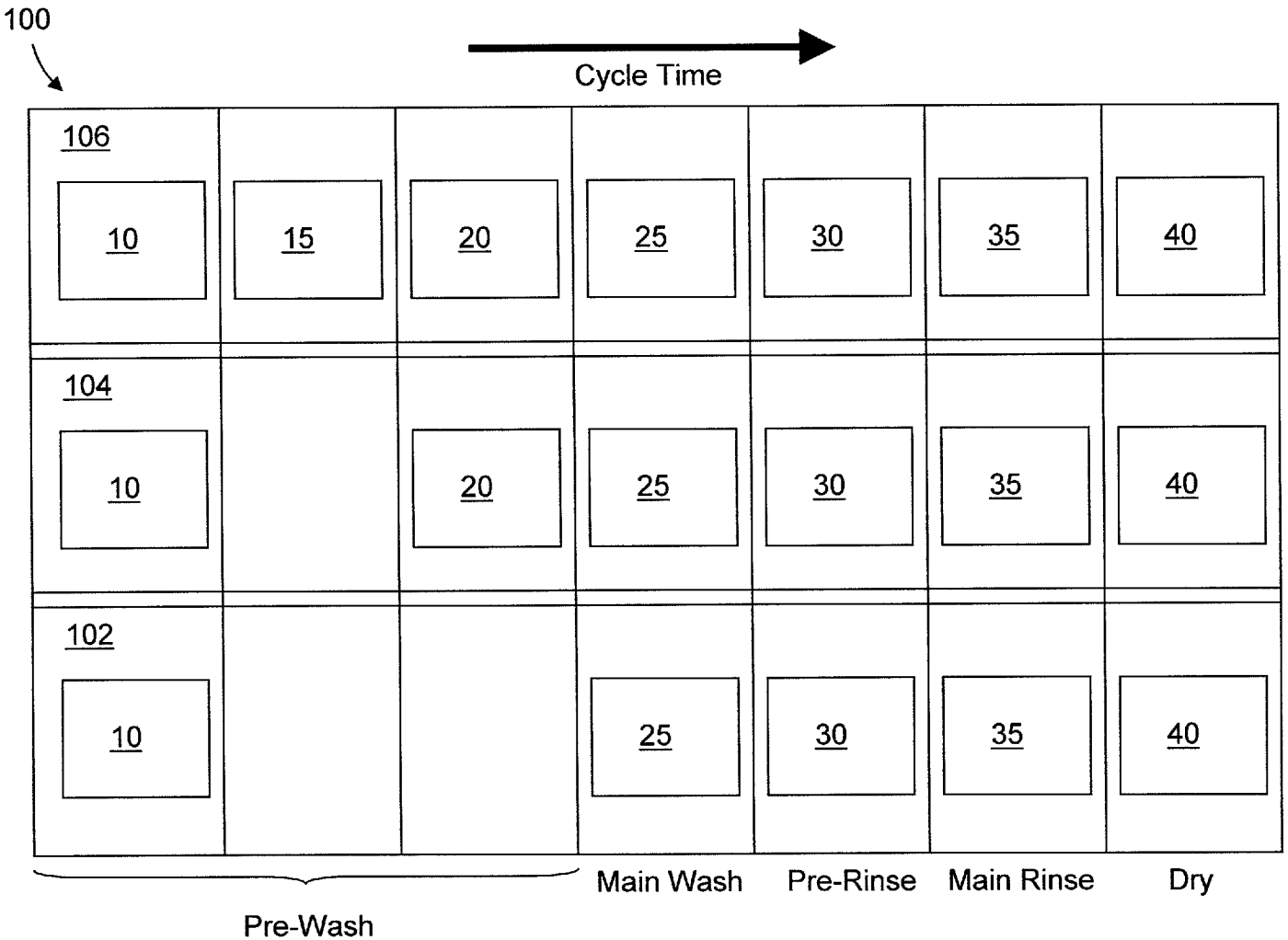
Figure 3:
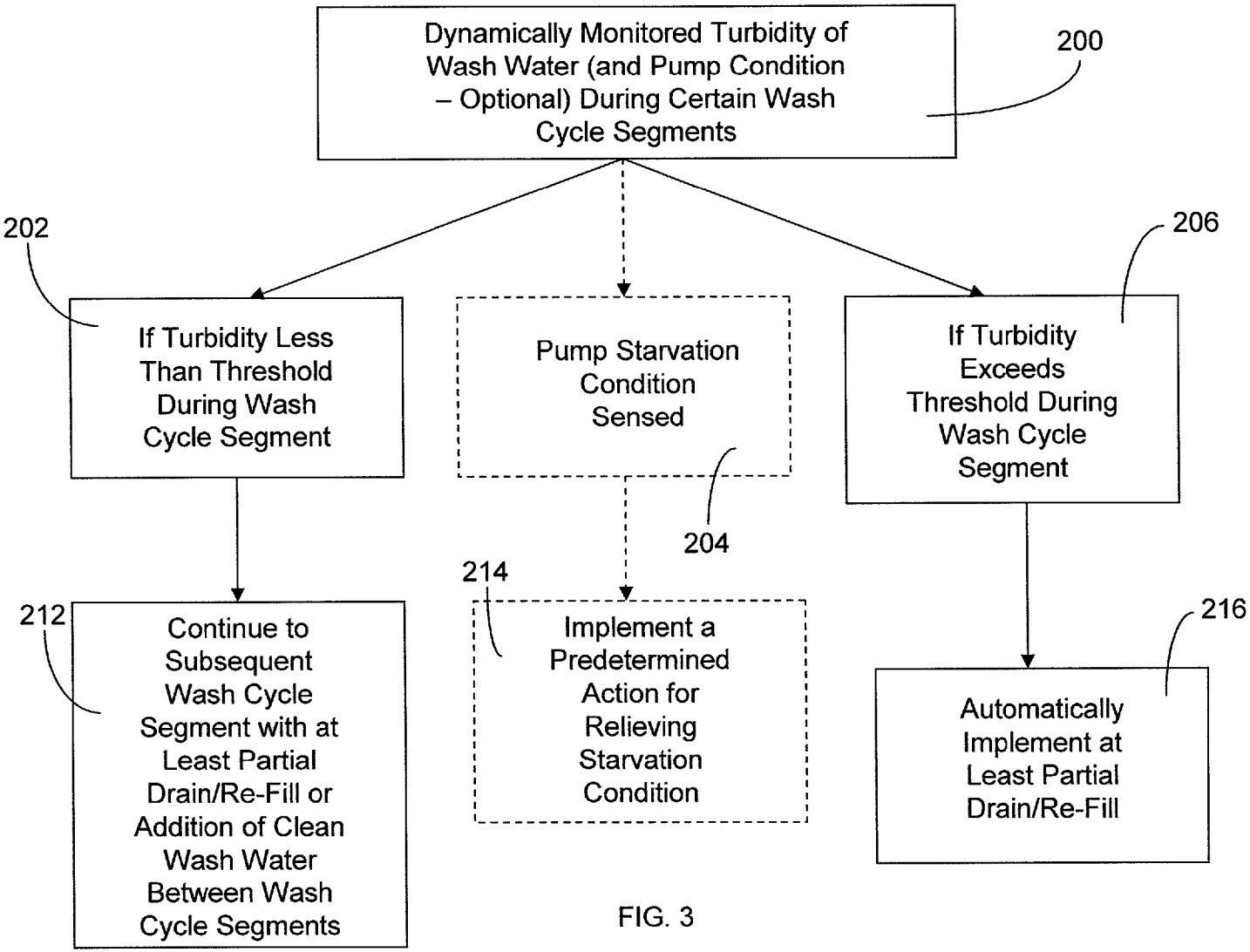

Having thus described the disclosure in general terms, reference will now be made to the accompanying drawings, which are not necessarily drawn to scale, and wherein:

FIG. 1 is a schematic of a dishwasher appliance according to one embodiment of the present disclosure;

FIG. 2 is a table illustrating a plurality of automatic wash programs, with each automatic wash program having at least one wash cycle segment with the wash water being continuously/dynamically monitored, according to one embodiment of the present disclosure; and FIG. 3 schematically illustrates a wash program for a dishwasher appliance, having at least one wash cycle segment with the wash water being continuously/dynamically monitored, in accordance with one embodiment of the present disclosure.

DETAILED DESCRIPTION OF THE INVENTION

The present disclosure now will be described more fully hereinafter with reference to the accompanying drawings, in which some, but not all embodiments of the disclosure are shown. Indeed, this disclosure may be embodied in many different forms and should not be construed as limited to the embodiments set forth herein; rather, these embodiments are provided so that this disclosure will satisfy applicable legal requirements. Like numbers refer to like elements throughout.

A dishwasher appliance typically includes a number of selectable automatic wash programs/cycles that each include different operational parameters for the dishwashing process. Depending on the nature of the load, a user may select, for example, a "normal" wash cycle for varying food soil levels on the dishware, a "china/crystal" wash cycle, an "economy" cycle, a "speed wash" cycle, or a "rinse and hold" cycle. In such instances, each wash cycle typically employs a series of wash cycle segments or portions (also referred to herein as "wash segments") such as "pre-wash", "pre-rinse", and "rinse" or "post-wash" segments. Such automatic wash programs (also referred to herein as "wash cycles") may be selectable by the user via a display screen or touch pad of a control panel or control device. In many instances, such a control panel is generally integrated into a portion of a pivotable door connected to the dishwasher appliance. The control panel typically includes or communicates with a control circuit (or "control device") configured to control or otherwise direct the operational parameters consistent with the particular automatic wash cycle selected by the user. That is, the user selects a wash cycle by, for example, pressing a button or other input device on the touch pad associated with the desired wash cycle. The wash program/cycle selection is then communicated to the control circuit for processing by, for instance, a microprocessor cooperable therewith to determine the operational parameters of the various dishwasher appliance components for effectuating the selected wash cycle. Accordingly, parameters such as, for example, particular durations for each cycle segment, the temperature of the water, and the amount of water used may be adjusted and controlled by the control circuit or other control device, as will be appreciated by one skilled in the art. One skilled in the art will further appreciate that, though aspects of the present invention are discussed herein in terms of a dishwasher appliance, that the concepts, apparatuses, and methods disclosed herein may be similarly applicable to other washing appliances such as, for example, a clothes washing appliance. As such, the aspects presented and disclosed herein are for exemplary purpose only and are not intended to be limiting in this respect.

In some instances, as shown in FIG. 1, the control device 310 of the dishwasher appliance 300 may also be in communication with one or more sensors or monitoring devices such as, for example, a turbidity sensor (see, e.g., element 320), which measures the amount of particulate suspended in the wash water within the dishwasher appliance as the wash water circulates through the dishwasher appliance's hydraulic system 330 and through the spray arms 340A, 340B, 340C for spraying the wash water onto the dishware (determination of the condition of the wash water as the wash water is circulated may also be considered "dynamic" or "continuous" monitoring within the scope of the present application). The turbidity of the wash water may be sensed at one or more locations within the dishwasher appliance as the wash water is circulated therein. In one aspect, a single turbidity is disposed within the hydraulic system prior to or otherwise associated with the feed of the wash water into a circulation pump 350. Such a turbidity sensor 320 may employ, in some instances, optical techniques (e.g., monitoring scattered or transmitted light with photodiodes to measure turbidity) so as to determine the turbidity of the wash water and transmit an indicia thereof to the control device 310. Accordingly, in response to the indicia from the turbidity sensor 320 or other monitoring device, the control device 310 may be further configured to determine whether or not a particular action must be taken. For example, in response to an above-threshold turbidity measurement, the control device 310 may direct at least a partial draining of the existing above-threshold wash water (i.e., by actuating a drain valve and/or drain pump 360) and refilling (i.e., by actuating a water inlet valve 370) with clean outside water (otherwise referred to herein as "at least a partial draining/refilling of the wash water"), as a measure for bringing the measured turbidity back below the threshold. That is, when the turbidity of the wash water exceeds a threshold due to food soils removed from the dishware, the removal of soiled water from and the addition of new clean water to (at least a partial draining/refilling) the dishwasher appliance 300 may be beneficial for reducing the level of soils recirculated back onto the dishware, and for limiting the load on the filter(s).

To that end, according to one aspect of the invention, the control device 310 may be configured to continuously or dynamically monitor a condition of the wash water (such as, for example, the turbidity of the wash water) during at least one pre-wash cycle segment and/or at least one post-wash (or "rinse") cycle segment. That is, the condition of the wash water is continuously ("dynamically") monitored as the cycle segment proceeds or is otherwise ongoing. In this manner, a continuous and/or dynamic measure of the turbidity of the wash water is determined up to and including the end of that particular cycle segment. Further, in some instances, the control device 310 may be configured to monitor the condition of the wash water in discrete instances such as, for example, at the end of a wash cycle segment, before the initiation of a wash cycle segment, or otherwise between wash cycle segments (i.e., instances when the circulation pump is not actuated, which may also be accomplished during a wash cycle segment by pausing or otherwise deactuating the pump for a particular time period). In such instances, the monitoring of the wash water when the circulation pump is deactuated may be considered a "static" determination of the condition of the wash water, and one skilled in the art will appreciate that such "static" determinations may also be within the scope of the present application.

In any instance, if a threshold for that monitored condition is exceeded, the control device 310 is further configured to direct or otherwise execute an appropriate action such as, for example, at least partially draining the soiled wash water from the tub portion 380 and then refilling the tub portion 380 with clean outside water from a water supply line/water inlet valve 370 engaged with the dishwasher appliance 300, when the turbidity exceeds a threshold. This response to the above-threshold condition, in some aspects, can be directed at any time after detection/determination thereof though, in some instances, the response (i.e., at least partially draining/refilling the tub portion 380) may be substantially instantly directed by the control device 310 so as to interrupt the ongoing wash cycle segment. In this manner, increased efficiency and energy and/or water conservation may be realized by discontinuing the ongoing wash cycle segment in response to an above-threshold condition of the wash water. Thus, rather than continuing to recirculate soiled water back over the dishware, efforts may be undertaken to reduce the turbidity or other above-threshold condition upon detection through the dynamic (continuous) monitoring scheme, thereby improving, for example, the effectiveness of the wash cycle (i.e., cleaner dishware), as well as the efficiency of the affected wash cycle segment(s), as compared to, for instance, configurations that determine the same condition of the wash water only on completion of a particular wash cycle segment (i.e., configurations where the turbidity of the wash water is only determined at the end of a wash cycle segment).

In one example, as shown in FIG. 2, a dishwasher appliance may be configured to include a control device configured to implement dynamic monitoring of a condition of the wash water in particular wash programs/cycles, such as, for example, dynamic turbidity monitoring of the wash water during a pre-wash cycle segment (in some instances, including a turbidity determination at the end of the cycle segment) to monitor the soiling condition of the wash water. In such a manner, if an above-threshold condition is detected (i.e., such as a high turbidity condition), the pre-wash cycle segment may be interrupted and at least a partial drain/refill may be conducted. That is, the wash water may be fully drained and then fully replaced/refilled with clean outside water, or the existing wash water may be partially drained and then refilled, in order to lower the determined turbidity or other condition of the wash water. The determination of whether full or partial draining/refilling procedure is conducted may depend on, for example, the level or extent of the detected turbidity determined by the monitoring device.

According to one particular automatic wash program menu 100, the dishwasher appliance may include two or more automatic wash programs such as, for example, a "normal" soil 102, a "heavy" soil 104, and an "extreme" soil 106 automatic wash program, each of which may be manually selectable by the user on the control panel of the dishwasher appliance. In one instance, the two or more automatic wash programs may be considered a "series" of automatic wash programs, with each subsequent automatic wash program selection having a configuration sufficient to address progressively changing soil levels which may be encountered due to the soils on the dishware placed within the dishwasher appliance. In such an embodiment, the "normal" soil automatic wash program 102 may include, for example, an initial wash (or pre-wash) cycle segment 10, during which the turbidity of the wash water may be continuously (dynamically) monitored. If the turbidity remains stable and below a certain threshold during the initial wash cycle segment 10, the "normal" soil automatic wash program 102 serially proceeds (horizontally across the row) to a main wash cycle segment 25, which is programmed to use high temperature heated water (e.g., 140° F.). The main wash cycle segment 25 may then be followed by a pre-rinse (post-wash) cycle segment 30, and then a main rinse cycle segment 35, before a drying phase cycle segment 40. A similar process may be followed for the heavy soil 106 and extreme soil 108 automatic wash programs, where each successive wash program includes a different parameter or cycle segment, or an additional cycle segment such as, for example, an additional pre-wash cycle segment 15, 20 over the previous wash program.

If the turbidity of the wash water is determined to be above a certain threshold at any time during the pre-wash cycle segment 10 of the "normal" soil automatic wash program 102, the initial pre-wash cycle segment 10 is interrupted, the wash water is at least partially drained and refilled, and another "pre-wash" cycle segment is performed (i.e., circulate the clean refilled water for pre-washing the dishware). During each additional/successive pre-wash cycle segment performed as a result of the detected above-threshold turbidity condition, or as a scheduled cycle segment of the selected automatic wash program, the turbidity may also be dynamically monitored, including up to the end of the respective pre-wash cycle segment. Accordingly, the wash water may be at least partially drained and refilled at any time during the pre-wash portion of the selected automatic wash program in response to an above-threshold turbidity determination.

In some instances, energy and water conservation may be realized if a partial drain/refill is implemented, instead of a full drain/refill procedure, if such would also be sufficient to appropriately lower the turbidity in the wash water. In some embodiments, up to four at least partial draining/refilling procedures may be performed during the pre-wash portion of the selected wash program. That is, in one embodiment, the pre-wash cycle segment 10 may be limited to four drain/refill procedures for a detected above-threshold condition of the wash water. If that limit is reached, the selected wash program would proceed to the subsequent wash cycle segment (i.e., "main wash"). In some instances, however, the control device may be configured to halt or pause the selected wash program, and notify the user that the drain/refill procedure limit has been reached. However, the number of drain/refill procedures per pre-wash portion may be limited or capped at any suitable number. One skilled in the art will appreciate that the exemplary procedure disclosed herein with respect to the "pre-wash" portion, may also be applicable, for example, to the "post-wash" portion (i.e., the pre-rinse cycle segment 30 and/or the main rinse cycle segment 35) of the selected automatic wash program. In such embodiments, the wash water may be continuously/dynamically monitored during the pre-rinse cycle segment 30 and/or the main rinse cycle segment 35, and at least partial draining/refilling procedures implemented as necessary in response to an above-threshold condition of the wash water, as similarly described with respect to the pre-wash cycle segment 10. In some instances, however, after conducting an at least partial draining/refilling procedure, the control device may be configured to "jump" to the next cycle segment in the wash program, instead of continuing the current cycle segment or repeating the current cycle segment.

In some instances, however, the soil level in the wash water may not reach the applicable turbidity threshold during the pre-wash cycle segment 10 (i.e., the wash water remains relatively clean during the pre-wash cycle segment 10) or other "pre-wash" portion of the wash cycle. In such instances, the wash water from the "pre-wash" portion may be at least partially carried over into the "main wash" cycle segment 25. That is, if the wash water is sufficiently clean at the end of the pre-wash cycle segment 10 (i.e., does not exceed the turbidity threshold, or is otherwise determined to be below a particular turbidity level) the "pre-wash" wash water is not fully drained and refilled. Instead, the wash water may be only partially drained and refilled. In other instances, the control device may direct that additional clean water be introduced into the dishwasher appliance, without any draining of the existing wash fluid. Thus, the "pre-wash" wash water may be at least partially carried over as the "main wash" wash water. In this manner, further energy/water conservation may be realized.

As previously discussed, the dynamic monitoring of the condition of the wash water may also be applied to the rinse or "post-wash" portion of the selected wash program, which may involve several rinse cycle segments such as, for example, a pre-rinse cycle segment 30 and a main rinse cycle segment 35. Generally, in the post-wash portion, clean water is desirable for rinsing the dishware, for example, to minimize the particulate matter introduced back onto the dishware. The level of particulate matter remaining on the dishware may be used, for example, to evaluate the cleanliness of the "washed" dishes and/or the efficiency of the wash program/dishwasher appliance. Accordingly, the wash water used in the "post-wash" portion may also be monitored by an appropriate monitoring device in communication with the control device of the dishwasher appliance. For example, such a monitoring device may comprise a turbidity sensor. As such, in a similar manner to the pre-wash portion, in some embodiments, if the "post-wash" or "rinse" water exceeds a turbidity threshold in the pre-rinse cycle segment 30, at least a partial drain and refill procedure, followed by another pre-rinse cycle segment, may be performed prior to the main rinse cycle segment 35. Further, if the rinse water remains sufficiently clean (low turbidity) at the end of the pre-rinse cycle segment, the rinse water may be partially drained and refilled or, alternatively, additional clean water introduced to the dishwasher appliance, such that the rinse water from the pre-rinse cycle segment 30 is at least partially carried over to the main rinse cycle segment 35, similarly to the pre-wash/main wash transition of the wash program.

As illustrated in FIG. 3, during the monitoring of the condition of the wash/rinse water, represented by block 200, the turbidity (as one example) of the wash/rinse water may exceed a predetermined threshold, represented by the block 206, during the corresponding "pre-wash" or "post-wash" wash cycle segment. In response, the control device halts the cycle segment and directs the implementation of at least a partial drain/refill procedure, represented by the block 216, of the wash/rinse water. If the threshold turbidity is not reached, represented by the block 202, by the end of the "pre-wash" or "post-wash" wash cycle segment, at least a partial drain/refill procedure is implemented, or clean water is added (without any draining), represented by the block 212, before progression to the "main wash" wash cycle segment. As such, the wash water from the pre-wash cycle segment 10 may be at least partially carried over to the "main wash" wash cycle segment 25. Similar procedures may be followed for "post-wash" wash cycle segments (i.e., the pre-rinse cycle segment 30 and the main rinse cycle segment 35).

Further, according to some embodiments, the circulation pump of the dishwasher appliance may also be monitored, represented by the block 200, to determine whether a drain/refill procedure for the wash/rinse water may be needed, as illustrated in FIG. 3. That is, due to the effectiveness of the filtration system in the dishwasher appliance, excessive soils and debris may lead to restrictions in the hydraulic system. As such, should soil levels (turbidity) be too high, the circulation pump may experience a "starvation" condition, represented by the block 204, since the wash water level in the sump may not be sufficiently high for the circulation pump (i.e., the flow of wash/rinse water to the circulation pump inlet is restricted by a clogged or otherwise impeded filtration system). This starvation condition may be evidenced by a rise in or a fluctuation of the RPM level of the pump motor driving the circulation pump. In such instances, the control device of the dishwasher appliance may implement a predetermined action for relieving the pump starvation condition, as represented by block 214. Such action may include, for example, slowing the pump motor RPM, or adding wash water to the dishwasher appliance so as to increase the wash/rinse water available for the inlet of the circulation pump. In some instances, the additional water or the pump motor RPM reduction may be sufficient to stabilize the circulation pump (i.e., reduce or eliminate the starvation condition). In other instances, however, if such measures are not sufficient to reduce or eliminate the starvation condition, the inadequacy of such measures may be treated by the control device as an "above-threshold" condition, as previously discussed. In such instances, the circulation of the wash/rinse water may be stopped, and a drain/refill procedure of the wash/rinse water performed.

In some instances, an appropriate pump monitoring device may be associated with the circulation pump, with the pump monitoring device being in communication with the control device. For example, the pump monitoring device may comprise an electronic tachometer. In other instances, the pump monitoring device may comprise, for instance, a suitable current measuring device monitoring or sensing the current draw of the pump motor.

One skilled in the art will further appreciate, however, that the starvation condition of the circulation pump can be determined in many different manners other than those previously discussed. For example, the starvation condition may be predicted/determined in relation to the water level in the dishwasher appliance (i.e., in the sump), or in relation to the discharge pressure of the wash water leaving the circulation pump. As such, the examples of methods for determining a starvation condition of a pump discussed herein are not intended to be limiting. Further, one skilled in the art will appreciate that other actions for relieving the pump starvation condition may be undertaken within the scope of the present application. For example, in instances where the circulation pump employs an inlet screen leading to the pump inlet (which may comprise filtration provisions separating the tub portion from the sump), the screen may sometimes become covered by food soils from the wash water. In such instances, though those food soils may be impeding a steady inlet flow of the wash water adequate for continuous operation of the circulation pump, the inlet flow may not be entirely blocked. As such, one responsive action may comprise repeated deactuation/actuation of the circulation pump via the pump motor thereof. That is, deactuation of the circulation pump in response to the impeded inlet flow condition would allow some time for the wash water to collect at the pump inlet. A subsequent actuation of the circulation pump would deplete the wash water collected at the pump inlet, but would pump the wash water through the spray arms to impart a cleaning action with respect to the impeded screen. Accordingly, such a corrective action may involve multiple deactuation/actuation pulses of the circulation pump, in order to relieve the starvation condition.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A washing appliance having a circulation pump for circulating a washing fluid in a tub portion, comprising:

a monitoring device configured to be capable of monitoring a condition of the washing fluid circulated within the tub portion; and a control device in communication with the monitoring device and configured to direct execution of one of a plurality of automatic wash programs by the washing appliance, each automatic wash program including a plurality of serially-conducted wash cycle segments, the wash cycle segments including at least one pre-wash cycle segment or at least one post-wash cycle segment during which the circulation pump circulates the washing fluid, the control device being further configured to:

direct the monitoring device to monitor the condition of the washing fluid at a plurality of predetermined discrete instances whereby the circulation pump is paused for a predetermined time period during, and prior to the completion of, the at least one pre-wash cycle segment and/or the at least one post-wash cycle segment of the executed wash program, wherein each predetermined discrete instance occurs at a predetermined time during the at least one pre-wash cycle segment and/or the at least one post-wash cycle segment; and direct an alteration of the washing fluid in response to the monitoring device determining that the condition of the washing fluid exceeds a threshold.

2. A washing appliance according to claim 1, wherein the alteration of the washing fluid further comprises at least a partial draining and refilling of the washing fluid in the washing appliance prior to the completion of the at least one pre-wash cycle segment and/or the at least one post-wash cycle segment.

3. A washing appliance according to claim 2, wherein the control device is further configured to direct execution of another of the one of the pre-wash cycle segment and the post-wash cycle segment having the above-threshold condition of the washing fluid, after the alteration of the washing fluid.

4. A washing appliance according to claim 1, wherein the control device is further configured to direct one of an addition of washing fluid to the washing appliance, and at least a partial draining and refilling of the washing fluid in the washing appliance, in response to the monitoring device determining that the condition of the washing fluid remains below the threshold, prior to the subsequent wash cycle segment in the automatic wash program.

5. A washing appliance according to claim 1, wherein the monitoring device further comprises a turbidity sensor configured to determine a turbidity of the washing fluid.

6. A washing appliance according to claim 5, wherein the turbidity sensor is disposed proximate to the circulation pump.

7. A washing appliance according to claim 1, wherein each automatic wash program further comprises a main wash cycle segment between the at least one pre-wash cycle segment and the at least one post-wash cycle segment.

8. A washing appliance according to claim 1, wherein the control device is further configured to monitor the circulation pump for a starvation condition and, in response to detection of the starvation condition, at least one of reducing an operational parameter of the circulation pump, adding washing fluid to the washing appliance, and at least partially draining and refilling the washing fluid in the washing appliance.

9. A washing appliance according to claim 8, wherein the operational parameter of the circulation pump further comprises an operational speed of a pump motor associated with the circulation pump.

10. A washing appliance according to claim 8, further comprising a pump monitoring device in communication with the control device, the pump monitoring device being configured to monitor an operational speed of a pump motor associated with the circulation pump and an electrical current draw of the pump motor, an increase in the operational speed and a decrease in the electrical current draw being indicative of the starvation condition.

11. A washing appliance having a circulation pump for circulating a washing fluid in a tub portion, comprising:

a monitoring device configured to be capable of monitoring a condition of the washing fluid circulated within the tub portion; and a control device in communication with the monitoring device and configured to direct execution of one of a plurality of automatic wash programs by the washing appliance, each automatic wash program including a plurality of serially-conducted wash cycle segments, the wash cycle segments including at least one pre-wash cycle segment and a main wash cycle segment during which the circulation pump circulates the washing fluid, the control device being further configured to:

direct the monitoring device to monitor the condition of the washing fluid at a plurality of predetermined discrete instances whereby the circulation pump is paused for a predetermined time period during, and prior to the completion of, the at least one pre-wash cycle segment of the executed wash program, wherein each predetermined discrete instance occurs at a predetermined time during the at least one pre-wash cycle segment;

direct an alteration of the washing fluid in response to the monitoring device determining that the condition of the washing fluid exceeds a threshold, wherein the alteration of the washing fluid further comprises at least a partial draining and refilling of the washing fluid in the washing appliance prior to the completion of the at least one pre-wash cycle segment; and direct wash water from the at least one pre-wash cycle segment to be at least partially carried over to the main wash cycle segment in response to the monitoring device determining that the condition of the washing fluid does not exceed the threshold.

12. A washing appliance according to claim 1, wherein the control device is further configured to monitor the circulation pump for a starvation condition and, in response to detection of the starvation condition, operate the circulation pump at a reduced speed.

13. A washing appliance according to claim 7, wherein the control device is further configured to direct wash water from the at least one pre-wash cycle segment to be at least partially carried over to the main wash cycle segment in response to the monitoring device determining that the condition of the washing fluid does not exceed the threshold.

14. A method of controlling a washing appliance having a circulation pump for circulating a washing fluid therein, comprising:

executing of one of a plurality of automatic wash programs in the washing appliance, each automatic wash program including a plurality of serially-conducted wash cycle segments, with the wash cycle segments including at least one pre-wash cycle segment or at least one post-wash cycle segment during which the circulation pump circulates the washing fluid;

monitoring a condition of the circulated washing fluid at a plurality of predetermined discrete instances whereby the circulation pump is paused for a predetermined time period during, and prior to the completion of, the at least one pre-wash cycle segment and/or the at least one post-wash cycle segment of the executed wash program, wherein each predetermined discrete instance occurs at a predetermined time during the at least one pre-wash cycle segment and/or the at least one post-wash cycle segment; and altering the washing fluid in response to the condition of the washing fluid exceeding a threshold.

15. A method according to claim 14, wherein altering the washing fluid further comprises at least partially draining and refilling the washing fluid in the washing appliance.

16. A method according to claim 15, further comprising executing another of the one of the pre-wash cycle segment and the post-wash cycle segment having the above-threshold condition of the washing fluid, after altering the washing fluid.

17. A method according to claim 14, further comprising at least one of adding washing fluid to the washing appliance, and at least partially draining and refilling the washing fluid in the washing appliance, in response to the condition of the washing fluid remaining below the threshold, prior to the subsequent wash cycle segment in the automatic wash program.

18. A method according to claim 14, wherein monitoring a condition of the circulated washing fluid further comprises monitoring a turbidity of the circulated washing fluid.

19. A method according to claim 18, wherein monitoring the turbidity of the circulated washing fluid further comprises monitoring the turbidity of the circulated washing fluid with a turbidity sensor disposed proximate to the circulation pump circulating the washing fluid.

20. A method according to claim 14, further comprising monitoring the circulation pump for a starvation condition and, in response to detection of the starvation condition, at least one of reducing an operational parameter of the circulation pump, adding washing fluid to the washing appliance, and at least partially draining and refilling the washing fluid in the washing appliance.

21. A method according to claim 20, wherein reducing an operational parameter of the circulation pump further comprises reducing an operational speed of a pump motor associated with the circulation pump.

22. A method according to claim 20, wherein monitoring the circulation pump for a starvation condition further comprises monitoring the circulation pump for a starvation condition with a pump monitoring device configured to monitor an operational speed of a pump motor associated with the circulation pump and an electrical current draw of the pump motor, an increase in the operational speed and a decrease in the electrical current draw being indicative of the starvation condition.

* * * * *